United States Patent [19]

Kobayashi et al.

[11] Patent Number: 4,881,878

[45] Date of Patent: Nov. 21, 1989

[54] GAS COMPRESSOR OF VARIABLE VOLUME

[75] Inventors: Takeshi Kobayashi; Junichi Asai, both of Narashino, Japan

[73] Assignee: Seiko Seiki Kabushiki Kaisha, Japan

[21] Appl. No.: 902,419

[22] Filed: Aug. 29, 1986

[30] Foreign Application Priority Data

Sep. 3, 1985 [JP] Japan ..... 60-194061

[51] Int. Cl.[4] ..... F04B 49/02; F04C 29/08

[52] U.S. Cl. ..... 417/295; 417/310

[58] Field of Search ..... 417/295, 310, 298, 304; 418/78; 62/228.5, 217

[56] References Cited

U.S. PATENT DOCUMENTS

| | | | |
|---|---|---|---|
| 3,120,814 | 2/1964 | Mueller | 418/159 |
| 3,224,662 | 12/1965 | Oldberg | 62/196.3 |
| 3,418,937 | 12/1968 | Cardillo | 417/270 |
| 3,434,428 | 3/1969 | Liles . | |
| 3,451,614 | 6/1969 | Tosh | 417/440 |
| 4,060,343 | 11/1977 | Newton | 418/78 |
| 4,137,018 | 1/1979 | Brucken | 418/47 |
| 4,330,999 | 5/1982 | Narayama | 62/217 |
| 4,421,462 | 12/1983 | Ohe | 417/310 |
| 4,557,670 | 12/1985 | Fuagaki | 417/310 |
| 4,566,863 | 1/1986 | Goto | 417/300 |
| 4,580,950 | 4/1986 | Sumikawa | 417/295 |
| 4,726,740 | 2/1988 | Suzuki et al. | 417/292 |

FOREIGN PATENT DOCUMENTS

| | | | |
|---|---|---|---|
| 174516 | 3/1986 | European Pat. Off. | 418/78 |
| 2057750 | 11/1970 | Fed. Rep. of Germany . | |
| 1173436 | 2/1959 | France . | |
| 91394 | 6/1982 | Japan | 417/295 |
| 729070 | 5/1955 | United Kingdom . | |
| 1291334 | 10/1972 | United Kingdom . | |

*Primary Examiner*—William L. Freeh

*Attorney, Agent, or Firm*—Bruce L. Adams; Van C. Wilks

[57] ABSTRACT

A gas compressor of the variable volume type having a rotary plate which is rotated to move recesses therein communicating with a compression chamber of a cylinder relative to communication ports formed in a front side block fixed to the one side of the cylinder so that the volume of the compression chamber may be made variable in accordance with the fast or slow running state of the gas compressor. The rotary plate is moved rotatably by means of a self-contained and self-actuated hydraulic cylinder which is driven by oil within the compressor in response to the intake pressure of the compressor's intake chamber.

22 Claims, 5 Drawing Sheets

GAS COMPRESSOR OF VARIABLE VOLUME

BACKGROUND OF THE INVENTION

1. Field of the Invention

The present invention relates to a gas compressor to be used with a car cooler or air conditioner and, more particularly, to a gas compressor in which the volume of its compression chamber is made variable.

2. Description of the Prior Art

Usually, a gas compressor to be used for cooling the automobile or the like is arranged in parallel with an engine so that it may be driven through a V-belt by the crankshaft pulley of the engine, and it is connected to or disconnected from the driving force by means of an electromagnetic clutch which is disposed on the compressor side.

As a result, the volume of the gas compressor of the above-specified type is increased in proportion to the r.p.m. of the engine. This in turn causes the gas compressor to be driven at a high speed, in case the automobile runs at a high speed, thereby to relatively overcool the automobile compartment and to raise the shortcoming that the power consumption is also increased in proportion to the running speed. This tendency is serious especially in a gas compressor of the rotary type.

In order to eliminate this defect,there have been proposed a variety of the so-called "volume-variable type" gas compressors in which the volume of the compression chamber for the coolant gas is varied in accordance of the compressor the driving speed thereof.

For example, the volume of the compression chamber can be made variable by controlling the opening of a bypass hole, which is formed in a position suitably displaced in the rotational direction of a rotor with respect to an intake port.

In the gas compressor of this type, the coolant gas, once confined in the compression chamber, is bypassed to an intake side after it has been compressed to some extent. Therefore, such a gas compressor has been noted to have an inferior compression efficiency and the drawback that the discharge temperature of the coolant gas rises especially at highspeed, i.e., small-volume run.

To overcome these shortcomings the gas intake compressor developed in recent years is of the type in which the intake capacity to be sucked in from an intake port of a front side block of the compressor is made variable by using a rotary plate as the front side plate, by forming this rotary plate with a recess communicating with the intake port, and by rotating the rotary plate a predetermined angle. In the gas compressors as developed, most have a means for controlling the rotary plate that are constructed such that the temperature of the air to be blown out of the automobile compartment or an evaporator is sensed by means of a thermostat so that the rotary plate may be turned by the drive of a motor attached to the compressor when the temperature drops to, or lower than, a set level of the thermostat. This raises certain defects in that the construction is complicated and large-sized due to the motor which is added.

For example, in U.S. Pat. No. 4,137,018, it is disclosed that a control plate is mounted between a cylinder and a front side block, and that the shaft 220 which gears with the control plate 200 (in the patent) drives the control plate 200. In this mechanism, however, another drive means for driving shaft 220 is required. It is not specifically described in the specification that this mechanism is controlled automatically. Provided that the control plate 200 is controlled automatically, the mechanism will be complicated on the whole, and will not be simplified and compact.

SUMMARY OF THE INVENTION

The present invention has been conceived in view of the background described above and provides a gas compressor of the so-called "variable volume type", in which the volume of the compression chamber for confining and compressing a coolant gas is made variable in accordance with the high and low running speeds so that the volume of the compression chamber is controlled in accordance with the intake pressure of an intake chamber while a control mechanism therefor is simplified and also made compact.

In order to achieve the above-specified object, according to the present invention, there is provided a gas compressor with comprises:

a cylinder (4) formed into a substantially elliptic or round shape;

a front side block (5) in which a communicating port or ports (12) is formed, and a rear side block (6), the two blocks being fixed to the two sides of the cylinder;

a rotor (9) fitted rotatably in a cylinder chamber (13) which is defined by the cylinder and the two side blocks, and carrying a plurality of vanes (8) mounted to protrude and retract radially from the rotor;

a rotary valve plate (10) borne rotatably within a predetermined angular range in the inner face of the front side block;

an intake chamber (15) which is defined between a front head (3) and the front side block (5);

and driving means (21) for rotatably moving the rotary valve plate, being driven by oil in the compressor in accordance with the intake pressure of the intake chamber, and rotatably moving the rotary valve plate to move an intake port or ports (16) communicating with the cylinder chamber (13) relative to the communicating port (12) so that the volume of a compression chamber may be made variable in accordance with the running state of the gas compressor.

DETAILED DESCRIPTION OF THE PREFERRED EMBODIMENTS

Figure 1:
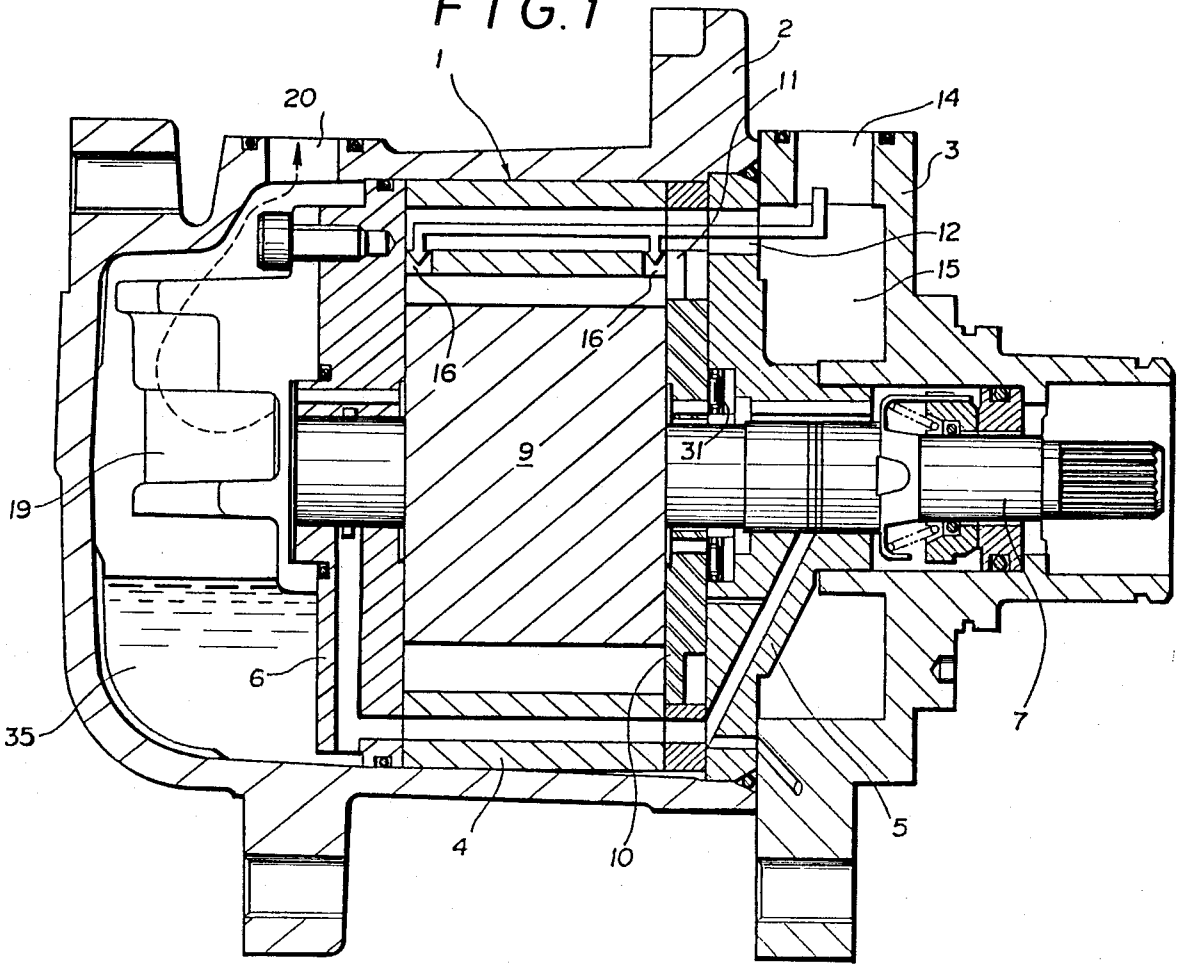
FIG. 1 is a longitudinal section showing the overall construction of the gas compressor according to the present invention.

The preferred embodiments of the present invention will be described in detail with reference to the accompanying drawings.

FIGS. 1 to 4 show a first embodiment of the gas compressor to which the present invention is applied.

This gas compressor is constructed of a compressor body 1, an open ended type casing 2 enclosing the body 1 gastight, and a front head 3 fixed to the open end face of said casing 2.

The aforementioned compressor body 1 is comprised of a cylinder 4 formed to have a generally elliptic inner periphery (see FIGS. 5 and 6), and front and rear side blocks respectively, 5 and 6, fixed to the two sides of cylinder 4. In the elliptic chamber 13 of the cylinder thus formed, there is rotatably fitted in a horizontal direction a solid, cylindrical rotor 9 which is integral with a rotor shaft 7 and carries on its outer circumference five vanes 8 enabled to protrude and retract radially from the rotor 9 (see FIGS. 5 and 6.

On the inner face of the aforementioned front side block 5, there is borne displaceable valve means in the form of a generally disk-shaped rotary valve plate 10 which is made relative to side block 5 angularly displaceable within a predetermined angular range.

Moreover, the aforementioned rotary plate 10 is formed in its peripheral edge with a valve opening or recess 11, through which coolant gas communication is provided between communication holes 12 in the front side block 5 and cylinder compression chamber 13.

In operation, as the intake pressure drops when the gas compressor is running at a high speed, the recess 11 of the rotary plate 10 is moved clockwise to reduce the volume thereof and to raise the intake pressure. Due to a rise in intake pressure in a low-speed run, on the other hand, the rotary valve plate 10 can rotate so that the recess 11 may move counterclockwise to maximize the volume. The means for driving the rotary plate 10 will be described hereinafter.

Figure 3:
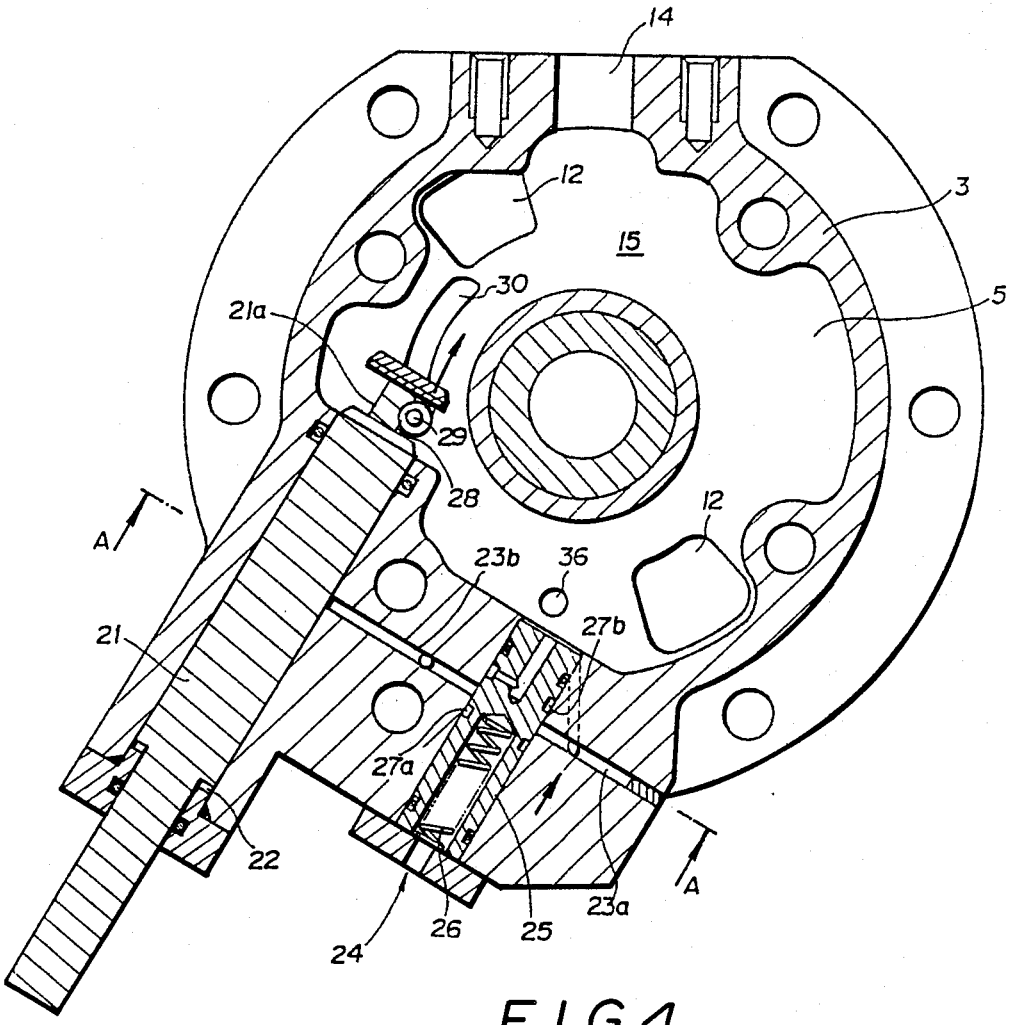
FIG. 3 is a transverse section showing the rotating mechanism of the first embodiment.

Thus, when the motor 9 is rotationally driven by rotor shaft 7 through conventional drive means (not shown), a coolant gas, which is introduced under a low pressure from an intake port 14 formed in the front head 3 into an intake chamber 15, is sucked, as indicated by solid arrows in FIG. 1, into the cylinder chamber 13 via intake ports 16 and both the communication holes 12 formed in the front side block 5 in diametrically opposed positions of 180 degrees and (see FIG. 3). Then, the gas is compressed to a high pressure and is supplied through a discharge port 17 and a discharge valve 18 (see FIGS. 5 and 6) and further through a communication hole, which extends into the gap between the cylinder 4 and the inner periphery of the casing 2 and is formed in the rear side block 6 with a phase difference of 90 degrees from the aforementioned communication holes 12, to an oil separator 19 which is formed at the back of said block 6, until it is discharged, as indicated by broken arrow in FIG. 1, from the rear space of the casing 2 to the outside through a discharge port 20. Denoted at numeral 35 appearing in the drawing is oil under a high pressure, which is used in the present invention as a fluid drive source for driving the rotary plate 10.

Figure 2:
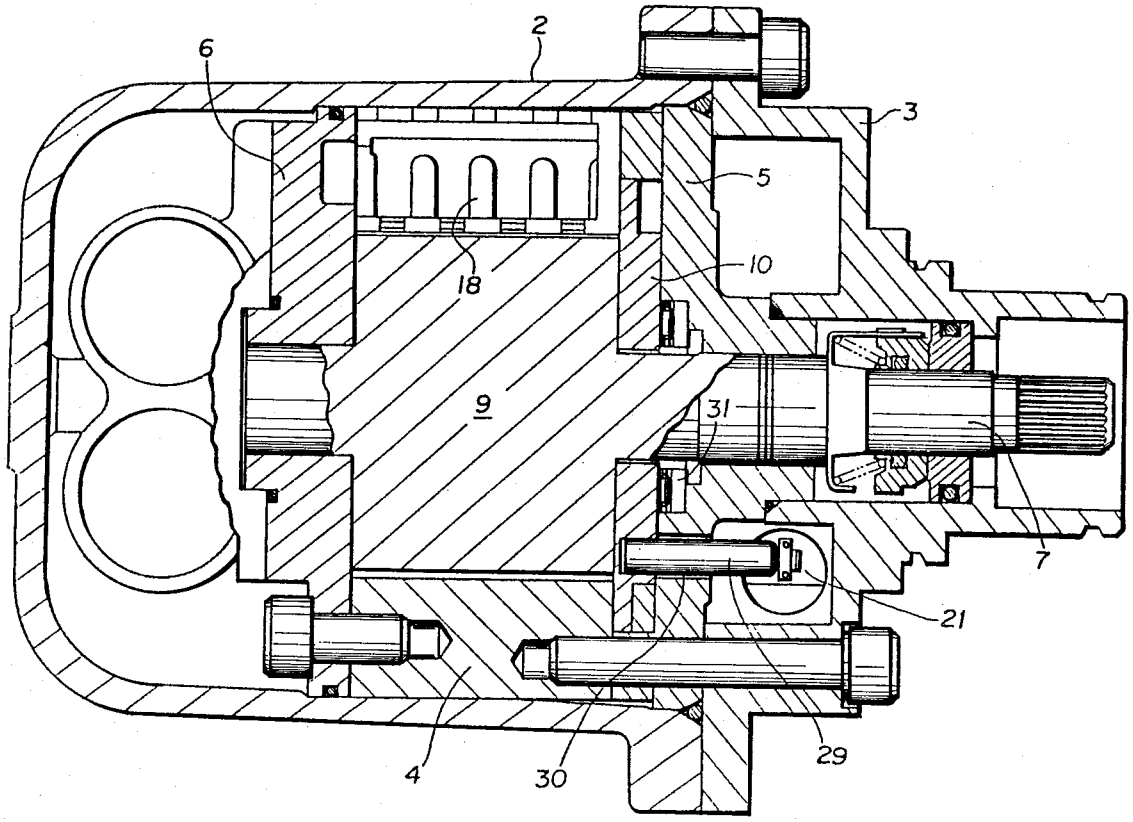
FIG. 2 is a longitudinal section showing a first embodiment of the gas compressor according to the present invention.
Figure 4:
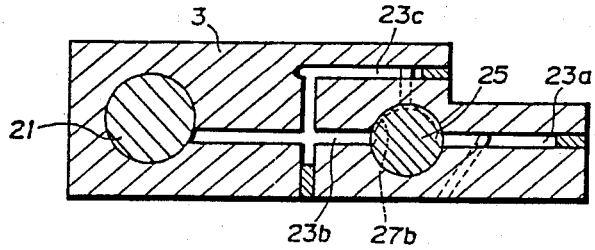
FIG. 4 is a longitudinal section taken along line A—A of FIG. 3.

Next, an essential portion of the present invention, i.e., the drive means for driving the rotary valve plate 10, will be described, especially with reference to FIGS. 2 and 4.

First, there is arranged in the front head 3 a hydraulic drive means piston 21 which is caused to protrude and retract in a direction perpendicular to the axis of the compressor. The hydraulic piston member 21 has front head portion 21*a* open to and communicating with the intake chamber 15 which is defined by said front head 3 and the front side block 5. At an intermediate portion of the piston member 21, there is formed a gap or gap chamber 22 into which is introduced the oil 35 at the side of the compressor via an oil passage (not shown) formed in the front head 3 and communicating with oil passage 23*a*, 23*b*, 23*c*. The rear portion of the piston 21 communicates with the outside ambient atmosphere. Front head 3 is arranged with pressure-responsive control valve means comprising a spool valve member 24 for opening and closing the oil passage. The spool valve member 24 is constructed of a cylinder 25 which is enabled to protrude and retract and which has its front end opened to and communicating with the intake chamber 15 and its rear end opened to the outside ambient atmosphere, and a spring 26 which is fitted in cylinder 25 and which has a predetermined spring force. Moreover, the spool valve member 24 is caused to move back and forth in front head 3 by the force difference between the intake pressure in the intake chamber 15 and the force of the spring 26 so that with the back and forth movement of the spool valve a communication port or groove 27*a* may accordingly alternately establish communication between oil passage 23*a* and 23*b*. Moreover, the hydraulic piston 21 is formed at its head end with an engagement portion 28, in which is loosely fitted the leading end of a drive pin 29 anchored upright from the rotary valve plate 10 and projecting into the intake chamber 15. Drive pin 29 extends through a cam groove 30 which is formed in an arcuate shape in the front side block 5.

Next, the operations of the rotary plate 10 will be described especially with reference to FIGS. 3 to 6.

Figure 5:
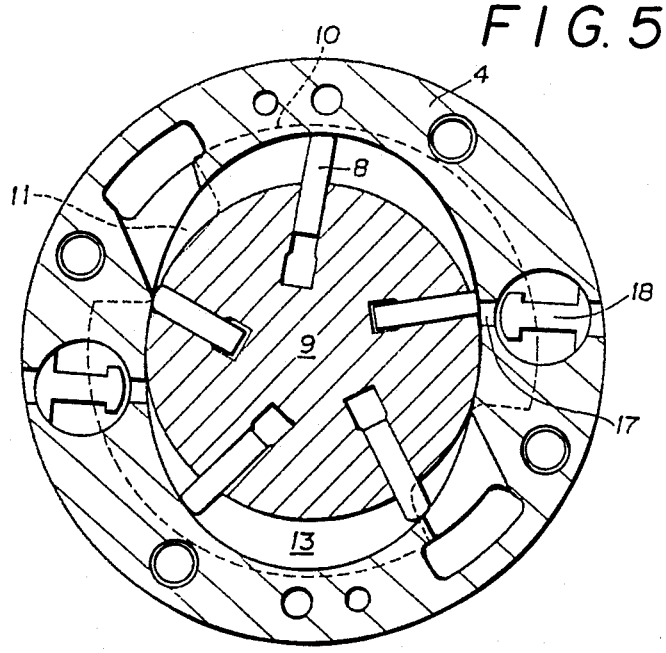
FIG. 5 is a transverse section showing the gas compressor when in the low-speed run.
Figure 6:
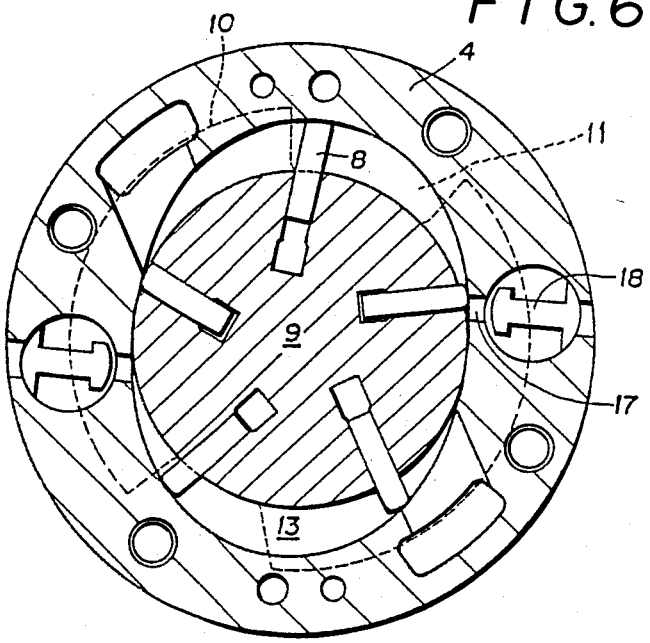
FIG. 6 is a transverse section showing the gas compressor when in the high-speed run.

In case the intake pressure of the intake chamber 15 is equal to or higher than a predetermined level, the hydraulic piston 21 and the spool valve member 24 will be located in the positions shown in FIG. 3, and the rotary valve plate 10 is located in the position shown in FIG. 5. In this state, the pressure of the gas in the intake chamber 15 acts on a working area of the front portion of the piston 21 to urge the piston 21 rearwardly. When the compressor comes into its highspeed running ranges, the intake pressure in the intake chamber 15 drops to a level lower than the predetermined level so that the spool valve member 24 has its cylinder 25 protruding into chamber 15 in the direction indicated by the arrow in FIG. 3. At this point the intake pressure in the intake chamber 15 is weaker than the biasing force of the biasing spring 26 in the cylinder 25, thus providing communication between the oil passages 23*a* and 23*b* via the communication port or groove 27*a*. As a result, the oil 35 at the side of the compressor has its speed controlled to a suitable value, while being throttled via oil passage 23 (i.e., 23*a* and 23*b*) by the axial clearance of the hydraulic piston 21, and the oil pressure is applied to a working area of the intermediate portion of the piston 21 via the gap chamber 2 so that the hydraulic piston 21 is caused to protrude by that oil pressure to push the drive pin 29 fitted loosely in the engagement portion 28 of the hydraulic piston 21 in the direction, as indicated by arrow in FIG. 3. As drive pin 29 rotates on its axis along the cam groove 30, the rotary valve plate 10 also rotates or angularly displaces between the positions shown in FIG. 5 (low speed) and FIG. 6 high speed because it is made integral with the drive pin 29.

Thus, when in a high-speed run, i.e., in case the intake pressure in the intake chamber 15 drops, the rotary valve plate 10 is caused to angularly displace by the operations described above thereby reducing the volume confining the coolant in the compression chamber so that the intake pressure can be held at a constant level (which may preferably be about 2 $Kg/cm^2$).

If intake pressure in the intake chamber 15 exceeds a predetermined level, the cylinder 25 is caused to retract to establish communication of an oil passage 23c with the communication groove 27b so that the oil fed to the gap 22 of the hydraulic piston 21 is returned to a lower-pressure chamber to thereby retract the hydraulic piston 21. As a result, the coolant confining volume of the compression chamber is enlarged.

At this time, the spool valve member 24 has already retracted to the position shown in FIG. 3, while blocking the communication between the oil passages 23a and 23b, so that no oil is fed to the hydraulic piston 21. Member 36 appearing in the drawing denotes a stopper for limiting the stroke of the spool valve 24.

Denoted at numeral 31 is which a thrust bearing which fitted on one side of the rotary plate 10 for smoothing the rotational motions of the same.

Figure 7:
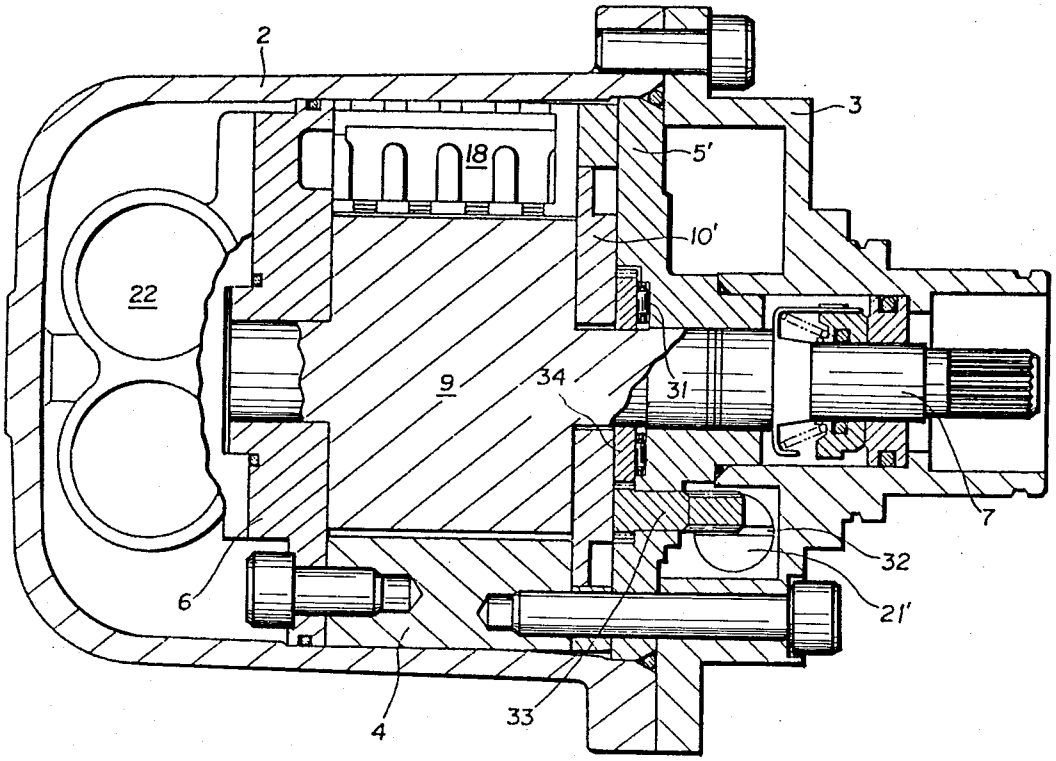
FIG. 7 is a longitudinal section showing a second embodiment of the gas compressor according to the present invention.

Next, a second embodiment of the gas compressor according to the present invention will be described with reference to FIG. 7.

The second embodiment is identical to the foregoing embodiment except for the drive means for the rotary valve plate 10, and the following description is directed only to the drive means.

In the second embodiment, a hydraulic piston 21' is directed like the foregoing embodiment at a right angle with respect to the axis of the compressor and similarly has one end 21a opened to the intake chamber. Moreover, this hydraulic piston 21' has its side formed with a gear rack portion 32, with which is meshed by an intermediate pinion 33. Pinion 33 is borne rotatably in a hole (not shown) of front side block 5' while extending therethrough. In a rotary valve plate 10' at the side of the front side block 5', on the other hand, there is concentrically borne plate pinion 34 which has a smaller diameter than that of the rotary valve plate 10'. Plate pinion 34 meshes with the aforementioned intermediate pinion 33.

As a result, responsive to the difference between the intake pressure in the intake chamber 15 and the force of the spring 26 of the spool valve member 24, the hydraulic piston 21' is caused to protrude and retract so that the intermediate pinion 33 meshing with gear the rack portion 32 is accordingly rotated thereby. Responsive to these rotations of the intermediate pinion 33, the plate pinion 34 is also rotated so that the rotary valve plate 10' is in turn angularly displaced a predetermined angle because the plate 10' is made integral with the plate pinion 34.

As in the first embodiment, the intake portion is moved so that the volume of the compression chamber of the coolant gas can be made continuously variable to hold the intake pressure at a constant level.

As has been described hereinbefore, the gas compressor according to the present invention is directed to a variable volume type, which is always run at an optimum volume. This is accomplished by rotating the rotary plate borne on the inner side of the front side block in a manner so as to hold the intake pressure at a constant level at all times in accordance with the change in the intake pressure of the intake chamber due to the running condition thereby controlling the effective volume for the compression in the cylinder chamber. For this operation, the hydraulic piston is moved back and forth through operation the spool valve, which is caused to differentiate in accordance with the intake pressure in the intake chamber, so that the rotary plate may be rotated by the protrusion and retraction of the hydraulic piston. As a result, it is possible to provide a remarkably practical gas compressor which can be freed from the problem of the rise in the discharge temperature of the coolant gas when it is run at small volume, as has been experienced by the volume variable type gas compressors of the prior art. Additionally, the present gas compressor has its construction made simpler than that in which the rotary plate is controlled by the system, and the present compressor can effect the control of the rotary plate compactly because the control does not resort to a motor attached to the compressor.

What is claimed is:

1. A gas compressor of the variable volume type comprising:

a cylinder having a substantially elliptic inner peripheral surface;

a front side block fixed to one end of said cylinder and having communicating gas ports therethrough communicating with the interior of said cylinder, and a rear side block fixed to the other end of said cylinder, the front and rear side blocks cooperating with the cylinder to define a cylinder chamber;

a rotor rotatably mounted in the cylinder chamber and carrying a plurality of vanes mounted to slidably protrude and retract radially of said rotor, the rotor and cylinder chamber cooperating with the vanes to define a compression chamber;

a front head mounted to said front side block and defining therebetween a gas intake chamber;

a rotary plate having at least one gas passage recessed therein,s aid rotary plate being mounted between said front side block and said cylinder to undergo angular displacement within a predetermined angular range; and driving means for angularly displacing said rotary plate in such a manner as to control the admission of gas to said compression chamber so that the volume of said compression chamber is made variable in accordance with the running speed of the gas compressor, said driving means comprising a hydraulic piston slidably disposed in the front head and having a rear end exposed to the outside atmosphere and a front end exposed to the gas intake chamber and engaged with the rotary plate, and valve means for controlling the flow of pressurized oil applied to the piston rear end by sensing the intake pressure in said intake chamber so as to angularly displace said rotary plate in response to the sensed pressure.

2. The gas compressor of claim 1 in which said hydraulic piston has an engagement portion that engages a drive pin projecting from said rotary plate into said intake chamber.

3. The gas compressor of claim 1 in which the rotary plate has recesses therein that permit gas to pass from the communicating ports to said compression chamber.

4. The gas compressor of claim 1 in which said valve means comprises a spring biased spool valve having one end exposed to said intake chamber so as to be responsive to changing gas pressures in said intake chamber.

5. The gas compressor of claim 4 in which a communicating oil passage connects said spool valve and a gap chamber of said hydraulic piston.

6. The gas compressor of claim 1 in which communicating oil passages are formed in the front head for introducing oil from a side of the compressor into a gap chamber formed at the rear end of said hydraulic piston.

7. The gas compressor of claim 6 including a valve mounted in the front head so as to protrude and retract into said intake chamber in response to pressure changes in the intake chamber, said valve controlling the opening and closing of said communicating oil passages in response to pressure changes in said intake chamber.

8. The gas compressor of claim 7 in which the valve is a spring biased spool valve which is biased into and projects inside the intake chamber at relatively low intake pressures.

9. The gas compressor of claim 8 in which limit stop means is mounted within said intake chamber for limiting the distance the spool valve projects into said intake chamber.

10. The gas compressor of claim 8 in which the biasing of said spool valve into said intake chamber at relatively low intake pressures opens said communicating oil passages to communicate oil to said gap chamber which projects said hydraulic piston into said intake chamber thereby angularly displacing said rotary plate.

11. The gas compressor of claim 10 and further including connecting means for connecting the projecting end of said hydraulic piston and said rotary plate.

12. The gas compressor of claim 11 in which said connecting means comprises a head and an engagement portion on the projecting end of said hydraulic piston, and a drive pin on said rotary plate.

13. The gas compressor of claim 12 in which the drive pin is mounted at a right angle to said rotary plate, the engagement portion is formed so the drive pin is loosely fitted to said engagement portion, and said drive pin is guided by an arcuate cam groove formed in said front side block.

14. The gas compressor of claim 11 in which said connecting means comprises a gear rack on the projecting end of said hydraulic piston, a meshing intermediate pinion, and a plate pinion concentrically mounted to said rotary plate.

15. The gas compressor of claim 14 in which the intermediate pinion extends rotatably through the front side block and meshes with said gear rack and said plate pinion.

16. A rotary vane-type gas compressor comprising: means defining a cylinder chamber having a peripheral inner surface and opposed closed ends; a rotor mounted to undergo rotation within the cylinder chamber and being rotationally driven during use of the compressor; a plurality of vanes slidably disposed in slots formed in the rotor such that the outer ends of the vanes make sliding contact with the cylinder chamber surface during rotation of the rotor, the vanes coacting with the rotor and cylinder chamber to define compression chambers between each two adjoining vanes; gas admitting means including an intake chamber receptive of gas under variable pressure during use of the compressor for admitting the gas into the compression chambers; displaceable valve means for regulating the flow rate of the gas from the intake chamber to at least one of the compression chambers in accordance with the displacement of the valve means to thereby control the compressor capacity; means including a movable piston member connected to effect displacement of the valve means in response to movement of the piston member, the piston member having a first working area in communication with the intake chamber so that the variable gas pressure in the intake chamber acts on the first working area to urge the piston member in one direction and having a second working area operative in response to fluid pressure applied thereto to urge the piston member in the other direction; pressure-responsive control valve means operative in direct response to the variable gas pressure in the intake chamber for controlling the application of fluid pressure to the second working area of the piston member to thereby control the movement of the piston member in the other direction in direct response to the variable pressure of the gas in the intake chamber; and gas discharging means for discharging compressed gas from the compression chambers.

17. A rotary vane-type gas compressor according to claim 16; wherein the displaceable valve means comprises an angularly displaceable valve plate having at least one valve opening therein for regulating the flow rate of the gas from the intake chamber to at least one of the compression chambers in accordance with the angular displacement of the valve plate by the piston member.

18. A rotary vane-type gas compressor according to claim 16; wherein the pressure-responsive control valve means includes a movable valve member having a front portion in communication with the intake chamber so that the variable gas pressure in the intake chamber acts on the front portion of the valve member to urge the valve member in one direction, biasing means for urging the valve member in the other direction, and a valve port on the valve member for communicating the second working area of the piston member with a source of fluid pressure in response to movement of the valve member in said one direction.

19. a rotary vane-type gas compressor according to claim 18; wherein the valve member has a rear portion in communication with the ambient atmosphere so that atmospheric pressure acts on the rear protion to assist the biasing means in urging the piston member in the other direction.

20. A rotary vane-type gas compressor according to claim 19; wherein the biasing means comprises a spring disposed within a hollow portion of the valve member.

21. A rotary vane-type gas compressor according to claim 16; wherein the piston member has a front portion defining the first working area, a rear portion in communication with the ambient atmosphere, and an intermediate portion between the front and rear portions defining the second working area.

22. A rotary vane-type gas compressor according to claim 21; wherein the pressure-responsive control valve means includes a movable valve member having a front portion in communication with the intake chamber so that the variable gas pressure in the intake chamber acts on the front portion of the valve member to urge the valve member in one direction, biasing means for urging the valve member in the other direction, and a valve port on the valve member for communicating the second working area of the piston member with a source of fluid pressure in response to movement of the valve member in said one direction.

* * * * *